US005645118A

United States Patent [19]

Lagarde

[11] Patent Number: 5,645,118

[45] Date of Patent: Jul. 8, 1997

[54] DEVICE FOR WINDING THE SUSPENSION CORD OF BLINDS

[75] Inventor: Eric Lagarde, Sallanches, France

[73] Assignee: SOMFY, France

[21] Appl. No.: 580,142

[22] Filed: Dec. 28, 1995

[30] Foreign Application Priority Data

Jan. 4, 1995 [FR] France ..... 95 00040

[51] Int. Cl.[6] ..... E06B 9/30

[52] U.S. Cl. ..... 160/170

[58] Field of Search ..... 160/170 R, 171 R, 160/168.1 R, 166.1 R, 172 R, 173 R, 176.1 R, 177 R

[56] References Cited

U.S. PATENT DOCUMENTS

| | | | |
|---|---|---|---|
| 2,250,106 | 7/1941 | Lorentzen | 160/170 R |
| 3,141,497 | 7/1964 | Griesser | 160/170 R |
| 4,955,421 | 9/1990 | Torti | 160/170 R |
| 5,103,888 | 4/1992 | Nakamura . | |
| 5,123,472 | 6/1992 | Nagashima et al. | 160/170 R |
| 5,178,200 | 1/1993 | Hagen | 160/171 R X |
| 5,184,660 | 2/1993 | Jelic | 160/171 R |
| 5,318,090 | 6/1994 | Chen | 160/171 R |
| 5,328,113 | 7/1994 | Villette et al. | 160/170 R X |

FOREIGN PATENT DOCUMENTS

| | | |
|---|---|---|
| 0 355 244 | 2/1990 | European Pat. Off. . |
| 408 694 | 9/1966 | Switzerland . |

*Primary Examiner*—David M. Purol

*Attorney, Agent, or Firm*—Laff, Whitesel, Conte & Saret, Ltd.

[57] ABSTRACT

The device has a winding drum (5) mounted fixedly in terms of translation in a frame (1) and to insure that the cord is wound in even turns without overlapping there is of a traveling nut (6) engaging with a screw thread formed on the winding drum and an eyelet for guiding (8) the cord at its entry into the frame (1). The nut moves between an end of the cord (7*a*) fixed to the drum and the guiding eyelet (8). In the traveling nut is furthermore advantageously mounted a retractable stop (13) controlled by the cord (7) in order to oppose the rotation of the drum in the direction of unwinding when the cord is slack.

5 Claims, 1 Drawing Sheet

DEVICE FOR WINDING THE SUSPENSION CORD OF BLINDS

FIELD OF THE INVENTION

The subject of the invention is a device for winding the suspension cord of a blind comprising a winding drum, to which is fixed the end of at least one suspension cord, and means for ensuring that the cord is wound in even turns without overlapping.

PRIOR ART

Blinds, whether they are awnings, venetian blinds, folded blinds or the like, generally comprise two suspension cords, one end of which is fixed to the winding drum and the other end of which is fixed to the free end of the blind. In order to ensure an even winding and unwinding of the blind, that is to say a lowering and a raising which are equal on both sides of the blind, for esthetic reasons and for mechanical reasons (the risk of jamming), it is necessary to ensure an even winding of the two suspension cords on the winding drum, in even turns, without overlapping. For this purpose, a known method is to move the winding drum with a motion of translation at the same time as the motion of rotation and of amplitude so that this translation is at least equal to the value of the diameter of the cord per revolution of the drum. Such embodiments are described in Patents FR 1 234 045, FR 1 319 645, CH 400 816, CH 408 694 and EP 380 346. The winding drum, which can move axially, comprises a threaded portion at one end. A corresponding threaded portion must be provided on its support. On the other side, which is to be used for its driving, an arrangement must be provided for allowing simultaneously the rotation and the translation induced by the threaded portions. All this is a source of complications and extra costs. In addition, the spaces necessary for the axial displacement must be left free and in certain embodiments (CH 400 816), they form gaps which increase the overall size of the blind support.

Lastly, when it is desired to place several blinds side by side, for example to equip oriel windows, and to use the driving motor of one of them for all the blinds, it is almost impossible to produce a simple kinematic link between the drums and the various blinds.

SUMMARY OF THE INVENTION

The aim of the invention is to obtain even winding of the cord without axial movement of the winding drum.

The winding device according to the invention is one wherein the winding drum is mounted fixedly in terms of translation in a frame having a guiding means for the vertical section of the cord and wherein the means for ensuring that the cord is wound in even turns without overlapping consist of a traveling nut which is immobilized in terms of rotation and engages with a screw thread formed on the winding drum, said nut moving between the end of the cord fixed to the winding drum and said cord guiding means.

When winding the cord, the turns form while bearing against a lateral face of the traveling nut. If the screw pitch is equal to or greater than the diameter of the cord, the latter then winds up in even turns without overlapping.

It is possible, other things remaining unchanged, to fit several traveling nuts onto one and the same winding tube, and also to establish a kinematic link between several winding tubes.

Over at least the larger part of the length of the winding of the cord onto the winding drum, the cord has to pass from one side to the other of the traveling nut. For space saving reasons and in particular if the winding drum together with its traveling nuts is mounted inside a box, the cord traverses the traveling nut. This passing of the cord through the traveling nut can advantageously be used to control a retractable stop, as is the case in the device represented in document EP 0 380 346. The retractable stop can consist of a simple rocker which rests on the section of the cord traversing the traveling nut in such a way that tensioning the cord has the effect of raising this rocker and of freeing the stop from the counter-stop formed on the winding drum.

BRIEF DESCRIPTION OF THE DRAWINGS

The appended drawing represents, by way of example, embodiment of the invention.

DESCRIPTION OF PREFERRED EMBODIMENTS

Figures 1, 2, 3, 4:
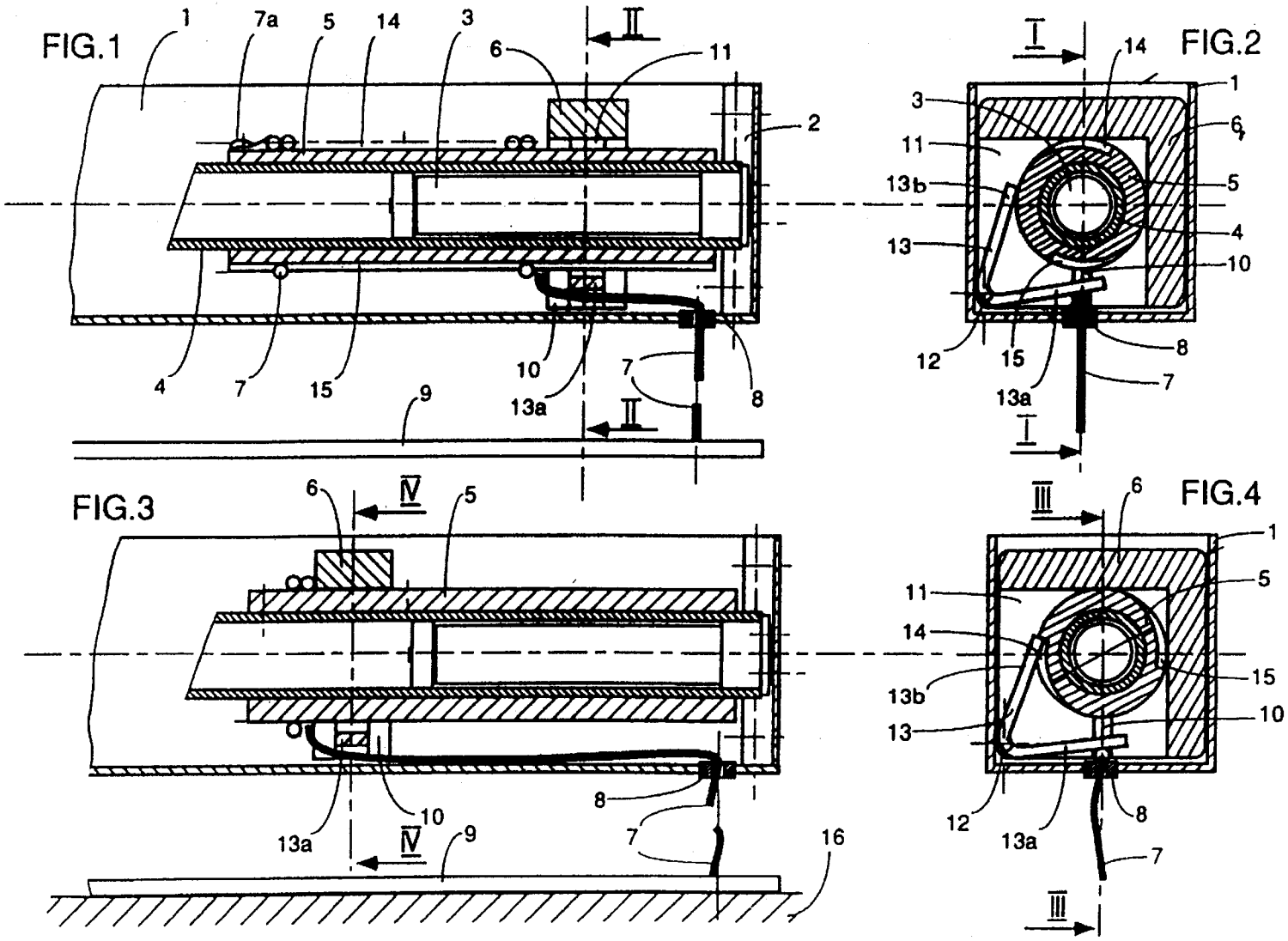
FIG. 1 is a partial, axial sectional view on I—I of FIG. 2, of a winding drum for a blind in a position close to complete winding.
FIG. 2 is a transverse sectional view on II—II of FIG. 1.
FIG. 3 is a view similar to that of FIG. 1, with the blind completely unwound.
FIG. 4 is a transverse sectional view on IV—IV of FIG. 3.

The winding device represented comprises a box 1 of rectangular parallelepipedal shape open at the top and furnished with two end plates, such as the plate 2, supporting a tubular motor 3 whose shell 4 carries and rotates a winding drum 5 furnished with a screw thread engaging with a traveling nut 6 of square shape with sides of length very slightly less than the inside width of the box 1, so that the traveling nut 6 is immobilized in terms of rotation but can move along the winding drum 5 when the latter rotates.

Fixed to the opposite end of the winding drum 5 from the plate 2 is the end 7*a* of a cord 7. This fixing is by any appropriate means, for example a screw, a slot or a ring. The cord 7 traverses the lower wall of the box 1, near to the end plate 2, through an eyelet 8 which serves as means for guiding the cord 7 in such a way that the latter descends vertically. It must in fact be imagined that the tubular shell 4 carries a second winding drum similar to the drum 5 onto which a second cord is wound. These two cords are fixed to a load rail 9 which constitutes the lower end of the blind, for example a slatted blind.

In its lower part the traveling nut 6 has a vertical slot, directed along the axis of the winding drum, for the passage of the cord 7. Furthermore, the traveling nut 6 has a vertical interior housing 11 in one of the lower corners of which there pivots, around a horizontal axis, a retractable stop 13 consisting of a V piece whose lower arm 13*a* traverses the slot 10 transversely and whose other arm 13*b* is intended to cooperate with two diametrally opposed counter-stops 14 and 15 each formed by a radial wall of a groove extending all the way along the winding drum 5. The bottom of the grooves is convex and almost tangential to the shell of the winding drum. As may be seen in FIG. 2, the winding drum 5 can always turn in a clockwise direction, that is to say in the cord winding direction, whereas in the opposite direction the end of the arm 13*b* can abut against one of the counter-stops 14 or 15.

So long as tension is exerted on the cord 7 by the weight of the load rail 9, the section of the cord traversing the traveling nut 6 is taut and takes up an oblique position which raises the arm 13*a* of the retractable stop 13, this having the effect of separating the end of the arm 13*b* from the winding drum 5, so that the winding drum 5 can turn in the counterclockwise direction corresponding to the unwinding of the cord, without the retractable stop preventing this rotation. By contrast, when the winding rail 9 reaches the sill 16 or when it encounters an obstacle, the tension in the cord 7 vanishes, thus enabling the retractable stop 13 to tilt under the effect of its own weight, in such a way that its arm 13*b* abuts against one of the counter-stops 14 or 15, thereby preventing the winding drum from continuing to turn and from bringing about untimely unwinding of the cord resulting in the turns overlapping and entangling In addition to the drawbacks eliminated by this construction, the latter has the advantage of great simplicity and of allowing the point of entry of the cord into the casing 1 to be taken back almost to the end of the blind.

The device according to the invention can of course also be used with manual drive.

Given the sudden changes in direction of the cord 7 on entering the casing 1 and after having traversed the traveling nut 6, the friction at these points may be considerable. It is however possible to reduce this friction by judicious roundings and/or by replacing the eyelet 8 with a roller.

The winding drum need not necessarily be mounted in a casing.

The retractable stop could be of some other shape and be furnished with a spring tending to hold it in a locked position.

The tubular shell generally carries a second winding tube furnished with a screw thread having the opposite sense to that of the winding tube represented and carrying a second traveling nut moving in the opposite direction to that of the traveling nut.

The winding drum 5 could have a single counter-stop, for example the counter-stop 14. The counter-stops 14 and 15 extend over a length of drum at least equal to the travel of the traveling nut 6.

I claim:

1. A device for winding at least one suspension cord with two ends of a blind comprising a winding drum (5) to which is fixed ode end (7*a*) of said suspension cord (7) and means for ensuring that said cord is wound in even turns without overlapping, wherein said winding drum (5) is mounted fixed in translation in a frame (1) having cord guiding means (8) for guiding said cord entering said frame and wherein said ensuring means comprise a traveling nut (6) which is blocked in rotation and engages with a screw thread formed on said winding drum (5), said traveling nut moving between said end of said cord fixed to said drum and said cord guiding means (8).

2. The winding device as claimed in claim 1, wherein the traveling nut (6) has a lower part in which a passage (10) for said cord is formed, said passage enabling said cord to traverse said traveling nut.

3. The winding device as claimed in claim 2, wherein the winding dram (5) has, on its circumference, at least one counter-stop (14, 15) extending at least over a length equal to the travel of the traveling nut (6) on said winding drum (5) and wherein the traveling nut carries a retractable stop (13) cooperating with the counter-stop of the drum in order to oppose the rotation of the winding drum in the direction of unwinding when the cord is slack.

4. The winding device as claimed in claim 3, wherein the retractable stop (13) includes a control arm (13*a*) resting on the cord so that the tension of the cord separates the stop from the counter-stop.

5. The winding device as claimed in claim 4, wherein the retractable stop (13) consists of a V-shaped piece, having a vertex (12) and two arms (13*a*, 13*b*) extending from said vertex, said piece pivoting on its vertex (12) in the lower part of said traveling nut, one arm (13*a*) of said arms resting on said cord (7) and the other arm (13*b*) of said arms cooperating with the notch (14, 15) of said drum.

* * * * *